US008444150B1

(12) United States Patent
Stirtz

(10) Patent No.: US 8,444,150 B1
(45) Date of Patent: May 21, 2013

(54) ROTATABLE TARGET FOR A BAG TOSS GAME

(76) Inventor: Ronald H. Stirtz, Creswell, OR (US)

( * ) Notice: Subject to any disclaimer, the term of this patent is extended or adjusted under 35 U.S.C. 154(b) by 295 days.

(21) Appl. No.: 12/931,014

(22) Filed: Jan. 21, 2011

(51) Int. Cl.
*A63B 63/06* (2006.01)

(52) U.S. Cl.
USPC ..... 273/390; 273/369; 273/400

(58) Field of Classification Search
USPC ..... 273/390–392, 398–402, 406, 407, 273/359, 369
See application file for complete search history.

(56) References Cited

U.S. PATENT DOCUMENTS

| | | | | | |
|---|---|---|---|---|---|
| 604,650 | A * | 5/1898 | Aske | 273/355 |
| 1,424,632 | A * | 8/1922 | Fenton | 273/392 |
| 1,491,888 | A * | 4/1924 | Stephenson | 273/396 |
| 1,629,386 | A * | 5/1927 | Hummerson | 273/390 |
| 2,085,933 | A * | 7/1937 | Vaughan | 273/388 |
| 2,415,780 | A * | 2/1947 | Wolf | 273/390 |
| 2,551,720 | A * | 5/1951 | Bevis | 273/390 |
| 3,656,748 | A * | 4/1972 | Howard | 273/387 |
| 3,744,792 | A * | 7/1973 | McClary et al. | 273/459 |
| 3,784,201 | A * | 1/1974 | Wyman et al. | 273/348.4 |
| 3,817,526 | A * | 6/1974 | Bibb | 273/390 |
| 4,240,213 | A * | 12/1980 | Lutin | 434/194 |
| 5,176,386 | A * | 1/1993 | Simmons | 273/392 |

* cited by examiner

*Primary Examiner* — Mark Graham
(74) *Attorney, Agent, or Firm* — Robert E. Howard

(57) ABSTRACT

A rotatable target for use in a projectile toss game using a projectile such as a bean bag. The rotatable target has a semi-circular main body portion having a base, a rim, and a substantially flat outer surface. A hub is located substantially at the axis of the main body portion. A plurality of shelves project outwardly from the outer surface of the main body portion, preferably at an angle of about 90 degrees. Preferably the shelves extend radially from the hub to the rim. A pendulum extends vertically downwardly below the hub. The pendulum has a vertically adjustable weight associated therewith. A target stand having a pivot pin that extends outwardly therefrom and through the hub of the main body portion in a manner adapted to allow the main body portion to rotate about the pivot pin.

10 Claims, 3 Drawing Sheets

Fig. 2
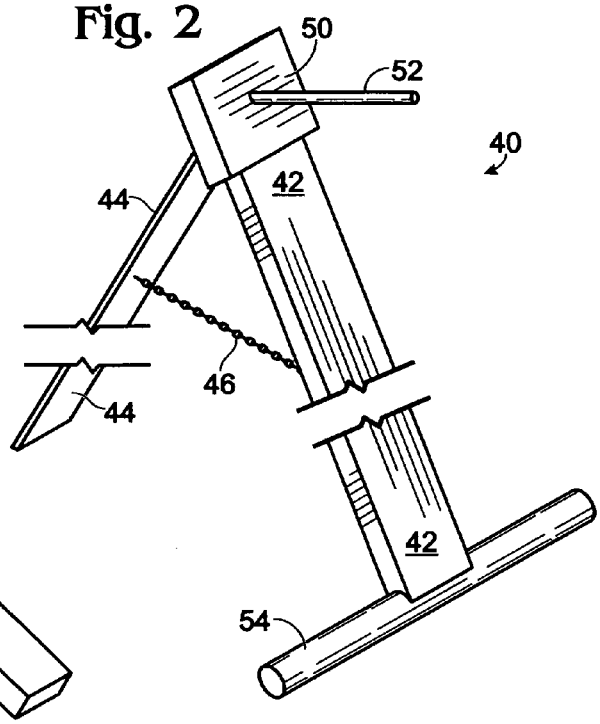
Fig. 4
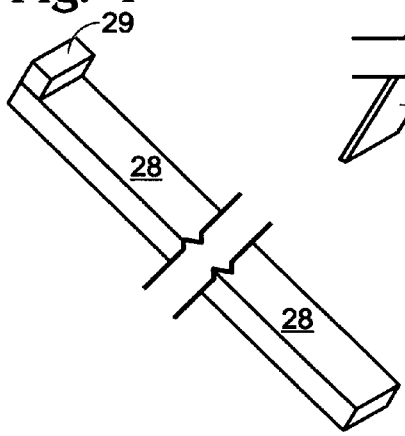
Fig. 5
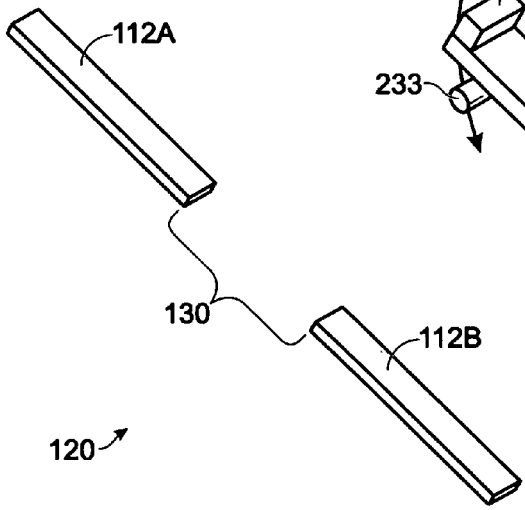
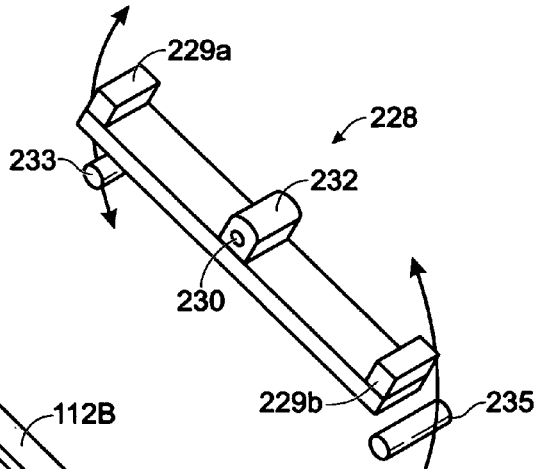
Fig. 6

ROTATABLE TARGET FOR A BAG TOSS GAME

BACKGROUND OF THE INVENTION

The present invention relates to a rotatable target for a bag toss game.

A number of games have been suggested in which a bean bag or similar projectile is thrown at a target. In most of these games the target has one or more openings through which the bag can be passed to score, such as described in U.S. Pat. Nos. 6,932,345 and 7,237,777. U.S. Patent Application Publication No. 2010/0194047 describes a bag toss game wherein the target includes both an opening through which a bag can be passed and shelves upon which the bags can be retained. The targets in these and other prior art bag toss games are stationary, i.e., do not move during the course of a game.

SUMMARY OF THE INVENTION

The invention is a target for a bag toss game that can rotate when its center of gravity is shifted from a stable, non-rotating region located below its axis at the beginning of a game to an unstable, rotating region located above its axis during the course of the game. The shift in the center of gravity of the target is caused by the accumulated placement of projectile bags on target shelves during play.

The preferred projectile is a "bean bag". Bean bags are bags of cloth or similar material that are filled with a granular material which originally was beans. Although such conventional bean bags would work with the target of the present invention, it is preferred to use a granular filler material that has a higher density, such as BBs or lead shot.

The bag toss game includes a target having a main body portion that is generally semi-circular in shape. The term "semi-circular" is intended to include a shape that is substantially a semi-circle or substantially the semi-polygon of a polygon having five or more sides.

Preferably the main body portion is slightly larger than a semi-circle or semi-polygon so as to include the axis of the main body portion within the boundary thereof. The "axis" of the main body portion is the center of the circle or polygon from which the semi-circular main body portion is formed.

Depending downwardly below the axis of the main body portion is a weight holding member (pendulum) that holds a weight in a manner adapted to allow the weight to be vertically adjusted up or down. Adjusting the weight upwardly raises the center of gravity of the target thereby making it less stable and raising the degree of difficulty of the game. Adjusting the weight downwardly lowers the center of gravity of the target thereby making it more stable and lowering the degree of difficulty of the game.

An opening (hub) is located at the axis of the semi-circular main body portion and is adapted to receive a pivot pin extending outwardly from a target support stand. The target support stand holds the target at an angle to the vertical so that it leans away from a player facing the target thus making the thrown bags more likely to remain in position. The target is adapted to rotate about the pivot pin upon the initial, stable, center of gravity of the target being raised into a region of instability.

The main body portion of the target has a plurality of shelves extending outwardly from the major plane of the main body portion at an angle of substantially ninety degrees, and, preferably, extending substantially from the hub to the rim along a radius of the semi-circular main body portion. The shelves are of a shape and size adapted to receive and hold bags tossed or thrown at the target. Preferably the shelves are substantially rectangular in shape and cross-section. Bags retained on that portion of a shelf closest to the hub are less likely to move the initial, stable, center of gravity of the target into a region of instability, and the target tends to remain in its initial position. Those bags retained on a portion of a shelf farther away from the hub are more likely to increase instability, which can cause the target to rotate about the pivot pin.

During the course of a game the earlier thrown bags will usually be directed by a player to a location on a shelf that is closest to the hub in order to prevent or minimize rotation of the target. Since later thrown bags cannot occupy the same space as earlier thrown bags, they will either have to occupy empty space on a shelf that is further and further away from the hub or fall to the floor or ground. Bags falling to the floor or ground would be considered to be a "foul" which would detract from the thrower's score and/or require that the bag be re-thrown. As more and more bags are held by the shelves at locations both nearer and further away from the hub, the higher the center of gravity of the target is shifted upwardly into a region of instability and such later thrown bags are therefore more likely to cause rotation of the target. Eventually a bag lands in a location on a shelf that causes the target to rotate and, depending on the degree of rotation, some or all of the bags are dumped off the shelves and onto the floor or ground.

Different sets of rules for different games using the target of the present invention can be devised, but, in general, the player dumping the fewest bags will prevail.

BRIEF DESCRIPTION OF THE DRAWINGS

FIG. 2 is a front perspective view of the rotatable target support stand;

FIG. 4 is a perspective view of the preferred shelf configuration of the rotatable target;

FIG. 5 is a perspective view of a first alternative shelf configuration of the rotatable target;

FIG. 6 is a perspective view of a second alternative self configuration of the rotatable target.

DESCRIPTION OF PREFERRED EMBODIMENTS

Figure 3:
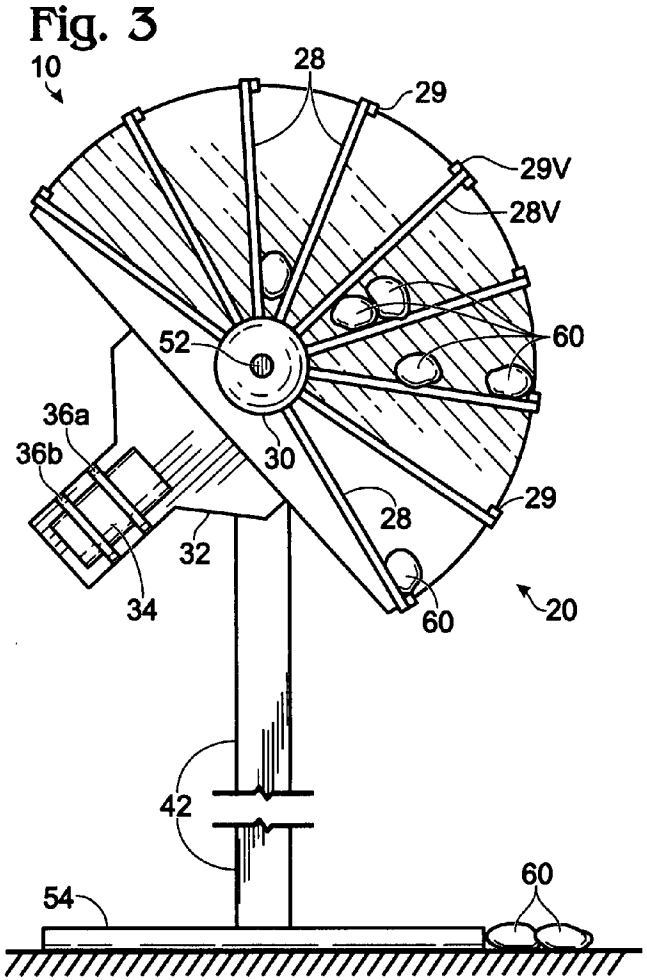
FIG. 3 is a front view of the rotatable target of the bag toss game of the present invention shown in a partially rotated position.

The bag toss game 10 of the present invention includes a rotatable target 20 and a target support stand 40.

Target 20 has a main body portion 22 that is slightly larger than a semi-circle and has a substantially flat outer surface 23 circumscribed by base 24 and perimeter rim 26.

A plurality of shelves 28 and 28V that are preferably generally rectangular in shape and cross-section project upwardly from the outer surface 23 of main body portion 22, substantially at an angle of ninety degrees to the plane of the outer surface 23. However shelves 28 and 28V can have a curvilinear cross-section to form a shallow elongated trough with a longitudinal axis that is substantially parallel to the plane of outer surface 23.

Shelves 28 and 28V preferably substantially extend between hub 30 and rim 26 along a radius of the main body portion 22, and are substantially equally spaced apart, preferably at an angle of between about 24 and 25 degrees. Shelves 28 are of a size adapted to hold a projectile bag tossed thereon. The spacing between shelves 28 and 28V in the region adjacent hub 30 is sufficient to allow a tossed projectile bag to reside.

It is preferred to locate end restrictions 29 at the outer ends of each of the shelves 28. End restrictions 29 of shelves 28 face towards the central vertical shelf 28V, and the end restriction 29V of vertical shelf 28V is located on both sides of the outer end of vertical shelf 28V. Although it is preferred to employ end restrictions 29 and 29V in order to impede movement of bags off the end of the shelves 28 when the shelves are at a shallow angle, they may be eliminated without greatly detracting from the functioning of target 20.

Hub 30 is located at the axis of semi-circular main body portion 22 and is adapted to receive pivot pin 52 from target support stand 40 there through A pendulum 32 extends downwardly below hub 30 and carries a weight 34 thereon. Weight 34 is adapted to be adjustable vertically upward and downward on pendulum 32, such as by means of straps 36*a* and 36*b*.

Pendulum 32 can be a separate member attached to main body portion 22 or can be formed integral therewith.

Target support stand 40 includes a forward leg 42 and a rearward leg 44. The upper end of rearward leg 44 is pivotally attached to head 50 of forward leg 42 to allow rearward leg 44 to be collapsed into contact with forward leg 42 for ease of storage and transport. A chain 46 or other suitable stop member determines the spacing between forward leg 42 and rearward leg 44 so that the angle of the target 20 presented to a player remains the same from game to game. Although it is preferred to have a free-standing target support stand such as stand 40, the stand could be adapted to be attached to a wall.

The upper end of forward leg 42 has a head 50 with a pivot pin 52 projecting outwardly therefrom. Pivot pin 52 is adapted to be received through hub 30 and to allow target 20 to be rotated thereabout. The lower end of forward leg 42 has a foot 54 attached perpendicularly thereto.

Figure 1:
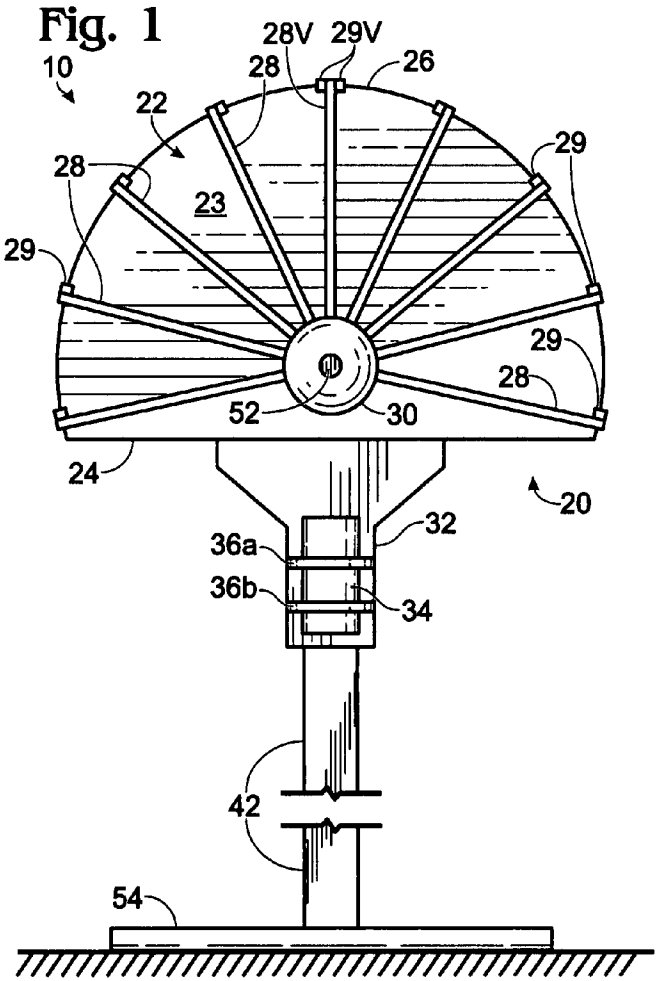
FIG. 1 is a front view of the rotatable target and its support stand for the bag toss game of the present invention, the target being shown in its initial position of rest prior to the start of a game.

In operation the target 20 and target stand 40 are carried to a location where it is desired to play a game. The target stand 40 is set up by pivoting rearward leg 44 backwards to the extent allowed by chain 46, as seen in FIG. 2. Target 20 is rotatably placed on target stand 40 by inserting pivot pin 52 through hub 30, as seen in FIG. 1.

Weight 34 can be adjusted upwardly to make target 20 become unstable with fewer bag throws, or downwardly to make target 20 become more stable thereby requiring more bag throws to reach instability.

In one form of the game two players evenly divide a predetermined number of bean bags 60 between them (e.g., a total of ten bean bags with five bean bags being given to each player). The bean bags 60 can be the same color or different colors. After choosing who goes first, the players alternately toss their bean bags 60 at target 20 so that each bag comes to rest on a portion of one of shelves 28. At some point a tossed bag will come to rest on a portion of a shelf 28 that causes the center of gravity of target 20 to shift into a zone of instability and cause target 20 to rotate, either partially (i.e., less than 360 degrees, as seen in FIG. 3) or wholly (360 degrees), thereby causing some or all of the bean bags 60 to slide outwardly along the shelf 28 on which they are located and to dump some or all of the bean bags onto the floor or ground, as seen in FIG. 3.

As described above, bean bags filled with a dense granular material are the preferred projectiles to be used with the target of the present invention. However it is clear that any projectile which tends not to bounce off the target upon impact therewith and which can slide along shelves 28 upon rotation of target 20 can be used. The bean bags or other projectiles could have a short flexible handle such as a rope attached thereto, or, in the case of bean bags, could be an empty extension of the filled bag itself.

Figure 7:
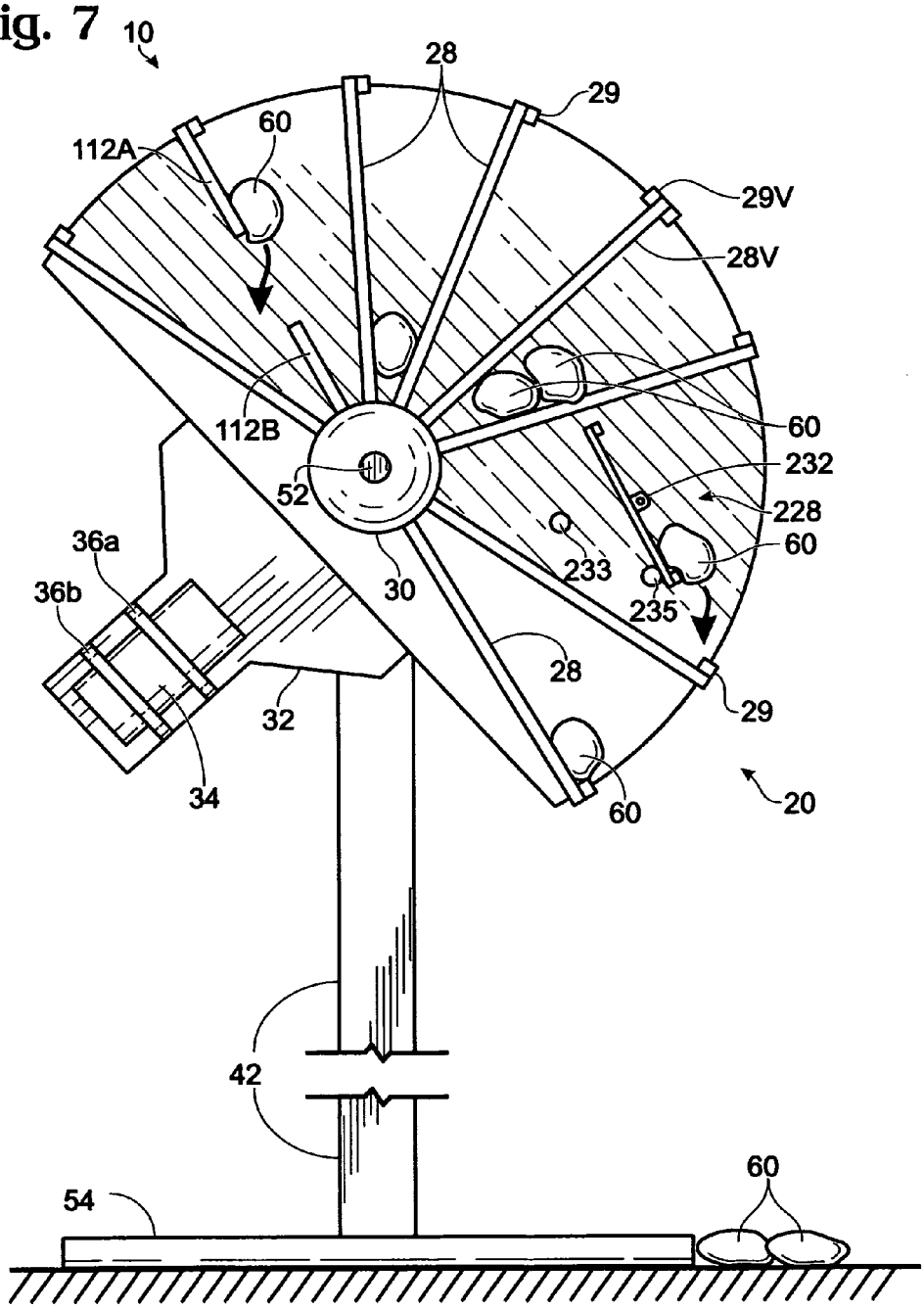
FIG. 7 is a front view of the rotatable target of the bag toss game of the present invention shown in a partially rotated position where two of the preferred shelf configurations have been replaced by one each of the first and second alternative shelf configurations.

FIGS. 5 and 6 show alternative shelf embodiments 128 and 228, respectively. Shelves 128 and 228 can be substituted for some but not all of shelves 28 of the preferred embodiment, either individually or in combination with each other Shelf 128 has two portions 128A and 128B with a gap 130 between the two portions which is large enough to allow a bag 60 or other projectile to pass there through to a lower shelf as shown in FIG. 7.

Shelf 228 is shorter than shelves 28 and 128, and is attached to target 20 by a pivot pin 230 extending through ear 231 which allows shelf 228 to pivot between stop members 233 and 235 located below the outer ends of shelf 228. Stop members 233 and 235 are affixed to and extend outwardly from main body portion 22 of target 20. When shelf 228 pivots, as shown by the arrows in FIG. 6, bags thereon can fall onto a lower shelf 28 as shown in FIG. 7.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A rotatable target for use in a projectile toss game comprising:

a substantially semi-circular main body portion having a base, a rim, and a substantially flat outer surface;

a hub located substantially at the axis of said main body portion;

a pendulum extending downwardly below said hub, said pendulum having a vertically adjustable weight associated therewith;

a plurality of shelves projecting outwardly from said outer surface of said main body portion, each of said shelves adapted to hold a projectile tossed thereon; and a stand having a pivot pin projecting outwardly therefrom, said pivot pin extending through said hub of said main body portion in a manner adapted to allow said main body portion to rotate about said pivot pin.

2. The rotatable target of claim 1 wherein said shelves are generally rectangular in shape and cross-section.

3. The rotatable target of claim 1 wherein said shelves substantially extend from said hub to said rim along a radius of said main body portion.

4. The rotatable target of claim 3 wherein said shelves are substantially equally spaced apart.

5. The rotatable target of claim 4 wherein that portion of said shelves located adjacent said hub are spaced apart a distance to allow a tossed projectile to reside.

6. The rotatable target of claim 4 wherein said shelves are spaced apart at an angle of between about 24 and about 25 degrees.

7. The rotatable target of claim 1 wherein at least one, but not all, of said shelves has an opening therein, said opening having a size adapted to allow a projectile to pass there through.

8. The rotatable target of claim 1 wherein at least one, but not all, of said shelves is a pivoting shelf mounted to said outer surface of said main body portion by pivot means.

9. The rotatable target of claim 8 wherein stop members are attached to said outer surface of said main body portion at a location below the inner and outer ends of said pivoting shelf to limit the range of pivoting.

10. A rotatable target for use in a bag toss game comprising:

a substantially semi-circular main body portion having a base, a rim, and a substantially flat outer surface;

a hub located substantially at the axis of said main body portion;

a pendulum extending downwardly below said hub, said pendulum having a vertically adjustable weight associated therewith;

a plurality of substantially equally spaced apart shelves projecting outwardly from said outer surface of said main body portion, said shelves being generally rectangular in shape and cross-section and of a size adapted to hold a bag tossed thereon, said shelves substantially extending from said hub to said rim along a radius of said main body portion; and a stand having a pivot pin projecting outwardly therefrom, said pivot pin extending through said hub of said main body portion in a manner adapted to allow said main body portion to rotate about said pivot pin.

* * * * *